United States Patent [19]

Massino, Sr.

[11] 4,261,565

[45] Apr. 14, 1981

[54] BALL AND METHOD OF MAKING SAME

[75] Inventor: Chester F. Massino, Sr., Sandwich, Ill.

[73] Assignee: Ideas That Sell, Inc., Sheridan, Ill.

[21] Appl. No.: 122,194

[22] Filed: Feb. 19, 1980

Related U.S. Application Data

[63] Continuation-in-part of Ser. No. 54,310, Jul. 9, 1979, which is a continuation-in-part of Ser. No. 930,716, Aug. 3, 1978, abandoned.

[51] Int. Cl.[3] ..... A63B 37/06; A63B 37/12

[52] U.S. Cl. ..... 273/60 R; 273/60 A; 273/65 EG; 273/DIG. 20; 40/327; 156/186

[58] Field of Search ..... 273/60 R, 60 A, 60 B, 273/58 A, 199 R, DIG. 20, 65 ED, 65 EB, 32 B; 156/186, 170; 40/327

[56] References Cited

U.S. PATENT DOCUMENTS

| | | | |
|---|---|---|---|
| 732,962 | 7/1903 | Rogers | 273/60 A |
| 777,045 | 12/1904 | Richards | 156/186 |
| 1,550,795 | 8/1925 | Fox | 273/60 R |
| 1,653,893 | 12/1927 | Eden | 273/58 A |
| 1,672,174 | 6/1928 | Ruedy | 273/60 R |
| 2,213,479 | 9/1940 | Voit et al. | 273/60 R |
| 2,242,455 | 5/1941 | De Beer | 273/60 R |
| 3,310,879 | 3/1967 | Brezezinski et al. | 273/32 B X |
| 4,065,126 | 12/1977 | Mantz | 273/58 A |
| 4,149,720 | 4/1979 | Heald | 273/60 R |

FOREIGN PATENT DOCUMENTS

| | | | |
|---|---|---|---|
| 471612 | 2/1951 | Canada | 156/186 |

OTHER PUBLICATIONS

"Belvidere Daily Republican," Oct. 21, 1975, p. 5.

*Primary Examiner*—George J. Marlo
*Attorney, Agent, or Firm*—Leydig, Voit, Osann, Mayer & Holt, Ltd.

[57] ABSTRACT

Balls comprised of (1) a generally spherically shaped center portion or core prepared from a piece(s) of material, such as a rag or sheet rubber, (2) cohesive tape at least partially covering this center portion, (3) yarn covering the cohesive tape-covered center portion, (4) additional tape (preferably cohesive) substantially completely covering this yarn layer, and (5) a synthetic cloth cover (preferably a double knit polyester). The cover is preferably formed of two figure eight-shaped cloth pieces which have short lines imprinted thereon extending inwardly from the perimeter of each cloth piece such that when the two cloth pieces are joined, corresponding short lines on each cloth piece are aligned such that they either intersect or would intersect if extended thereby simulating the stitching utilized in the construction of conventional baseballs and the like. The balls of this invention have substantially the same size, shape and performance characteristics (particularly the aerodynamic characteristics) of the balls they are meant to replace, i.e., baseballs or softballs, when thrown or hit, but are softer and lighter, allowing for their use in congested areas—they do not travel as far when hit—and by or with young children who are more susceptible to injury with hard balls or handicapped persons who are similarly susceptible to injury and who may have special difficulty with hand-eye coordination.

17 Claims, 11 Drawing Figures

FIG. 7
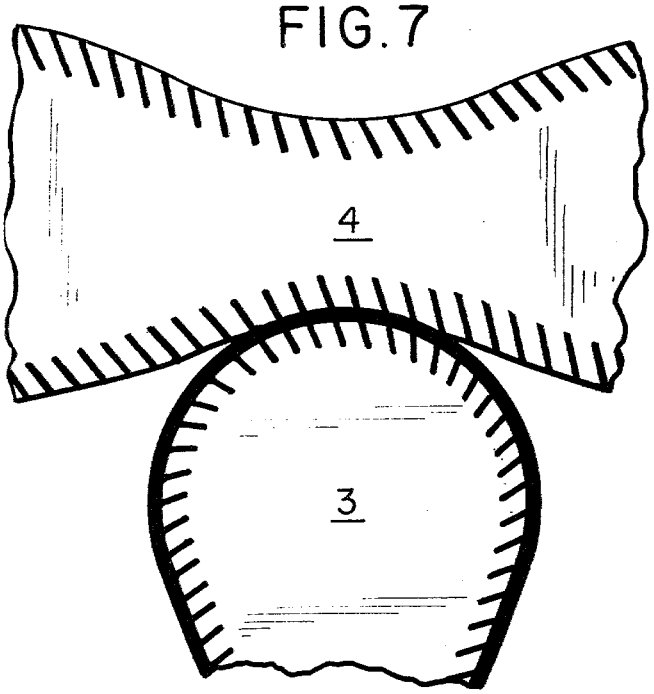
FIG. 8
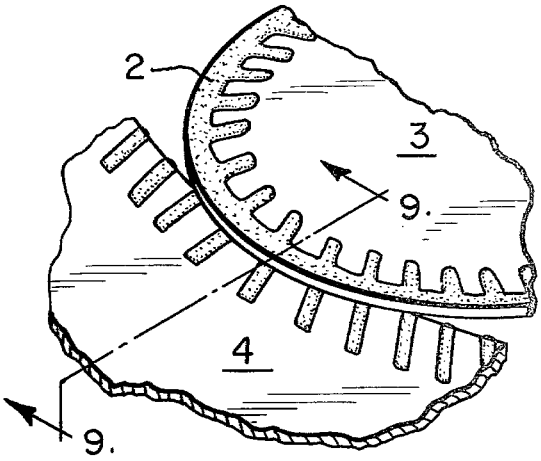
FIG. 9
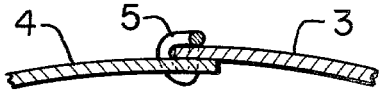
FIG. 11
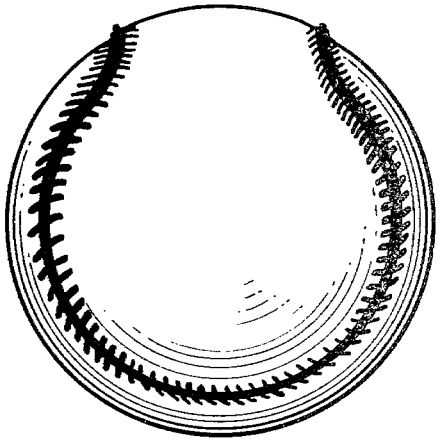
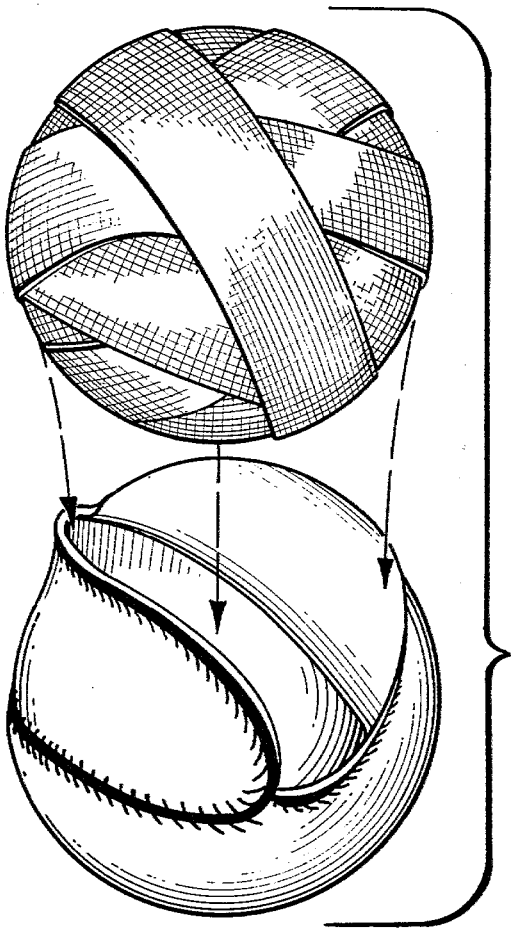
FIG. 10

BALL AND METHOD OF MAKING SAME

CROSS REFERENCES TO RELATED APPLICATIONS

This application is a continuation-in-part of (1) Ser. No. 054,310 filed July 9, 1979 which in turn is a continuation-in-part of (2) U.S. Application Ser. No. 930,716, filed Aug. 3, 1978 (now abandoned).

BACKGROUND OF THE INVENTION

This invention relates to balls, more particularly to balls which can be substituted for baseballs or conventional softballs (there are various types used as discussed hereinafter) where space is limited, where the players are more susceptible to injury by the use of a hard ball such as a baseball or conventional softball, and where the surrounding property is susceptible to damage, e.g., windows.

Baseballs and similar type balls having a relatively hard form, typically containing a resilient rubber center and a leather cover, have, of course, been used for years. A need for a lighter, softer and potentially less dangerous ball has long been recognized by the sporting industry. Various alternatives such as balls made of polyurethane foam, rubber, plastic or the like (the "Wiffle" ball is one example of this type of ball) have been manufactured but have met with limited success. While these lightweight balls have been used, they have not had a great degree of success because the performance characteristics of these substitutes have been substantially different from the conventional balls, e.g., baseballs, softballs, etc., that they have sought to replace and their durability has in many cases been less than desirable.

Lighter, softer and less dangerous balls which would still have the performance characteristics of a baseball or the various types of conventional softballs would be of substantial benefit to the sporting public for the following reasons: (1) the ability to play the game well could be learned while reducing exposure to injury; (2) the technical skills required to play the game well would still be required; (3) the skills could be learned and applied in confined spaces such as smaller playing fields, yards, and gymnasiums since the ball could not be hit as far; and (4) there would be less danger to the participants. The latter is of particular benefit with young children who have not yet developed the hand-eye coordination needed to catch a baseball or softball hit or thrown at high speed.

The subject ball can be used in organized team play for unique drills to develop batting and fielding skills from pre-Little League to university level. The drills were heretofore not possible as no safe alternative to a conventional ball (but having the needed performance characteristics of a conventional ball) was available.

Drill #1. A batter avoids being hit by a pitched ball. The ball described herein is thrown out of a pitching machine toward the head of the batter. The batter practices various techniques for avoiding being hit.

Drill #2. Blocking drills for catchers. This drill (involving, e.g., preventing or blocking a low pitch in the dirt from getting by him) when using a conventional baseball often results in soft tissue injuries. The balls of this invention enable the catcher to develop the necessary skills while avoiding these soft tissue injuries.

Drill #3. "Soft Hand Drill". Catchers, outfielders and infielders catch high fly balls thrown from a pitching machine bare-handed to reduce proneness to errors.

The subject invention is directed to balls useful in the manner described above and the method of making them.

DESCRIPTION OF PRIOR ART

A ball having certain of the characteristics of this invention has been described in the prior art. In the Oct. 21, 1975 edition of the *Belvidere Daily Republican*, a daily newspaper published by the Belvidere Daily Republican Co. of Belvidere, Ill., a ball having a rag center which has been wound with yarn, covered with white adhesive tape and finished by stitching on a cloth cover is described. This ball while lighter than a baseball is characterized as being of almost the same size but much softer, allowing pitchers to throw "junk" pitches with greater ease. The distance the ball travels when hit is described as greatly reduced.

U.S. Pat. Nos. 1,653,893, 1,672,174, 2,242,455, 3,310,879 and 4,065,126 were cited by the Examiner in parent application U.S. Ser. No. 930,716 referred to above. None of them were relied on by the Examiner and they are believed to be of only general interest.

SUMMARY OF THE INVENTION

According to the invention, balls noticeably lighter and softer than the conventional baseballs or conventional softballs they are meant to replace but being durable and having the general appearance, size, shape and performance characteristics of conventional baseballs or conventional softballs (particularly the aerodynamic characteristics) are provided. The balls are comprised of a spherical center portion prepared from a piece(s) of material preferably wadded into a generally spherical shape and which spherically shaped center portion or core is then at least partially covered with cohesive tape. The cohesive tape covered center portion is then wound with yarn and this structure is in turn substantially completely covered with tape, preferably cohesive. If a waterproof ball is desired, the yarn may be covered with cohesive tape which is then covered in turn with a waterproof tape, such as adhesive tape or, alternatively, but less desirably, the waterproof tape can be used to cover the yarn directly without the use of cohesive tape. This interior spherically-shaped structure is then finished by covering it with a synthetic cloth cover (preferably by sewing a properly shaped double-knit polyester cloth cover in place). The generally spherical core can also be prepared by rolling a piece of cloth or sheet rubber into a generally cylindrical shape (with a height about equal to the diameter of the cylinder) to form the core, and then securing the core in this configuration with cohesive tape.

The cover is preferably formed of two figure eight-shaped cloth pieces which have short lines imprinted thereon extending inwardly from the perimeter of each cloth piece such that when the two cloth pieces are joined, corresponding short lines on each cloth piece are aligned such that, on the finished ball, the lines either intersect or would intersect if extended thereby simulating the stitching utilized in the construction of conventional baseballs and the like. The invention described herein includes the use of this type of cover for a spherically shaped ball with any kind of spherically-shaped interior structure, albeit the preferred interior structure is that generally described above.

BRIEF DESCRIPTION OF THE DRAWING

FIG. 7 is a plan view of the head portion 3 of the second figure eight cloth piece (see FIG. 6) placed on top of the waist portion 4 of the first figure eight cloth piece (FIG. 5) such that the perimeter-line of the second piece overlaps the first piece.

FIG. 8 is a perspective view showing the overlapping of the cloth piece shown in FIG. 6 on the cloth piece shown in FIG. 5.

FIG. 9 is a cross sectional view of the overlapping figure eight cloth pieces, showing the stitching 5 used to secure the cloth pieces to each other.

FIG. 10 is a perspective view of the finished interior structure of the ball being placed inside the pocket or cup made by stitching the two figure eight cloth pieces (of FIGS. 5 and 6) together along the major portion of their perimeters.

FIG. 11 is a perspective view of the finished ball.

DETAILED DESCRIPTION OF THE INVENTION

The present invention is predicated on the discovery that by the proper selection of materials and the proper manufacturing technique, balls having the general appearance, size, shape and characteristics of conventional baseballs or conventional softballs can be produced. However, the balls of the subject invention require less space—a smaller field—in which to play since the balls do not travel as far when hit. Additionally, there is less danger to limb and property since the balls are softer and lighter, reducing the likelihood of broken windows and injury to individuals struck by the balls.

The following detailed description of the method of manufacture referes in part to the figures briefly described above and is generally applicable to substitute baseballs and substitute softballs. Where a particular alternative technique or step that may be used either is not disclosed in the figures, can be modified from the technique shown therein or is particularly applicable to a particular type of substitute ball, the alternative is specifically described below.

Figure 1:
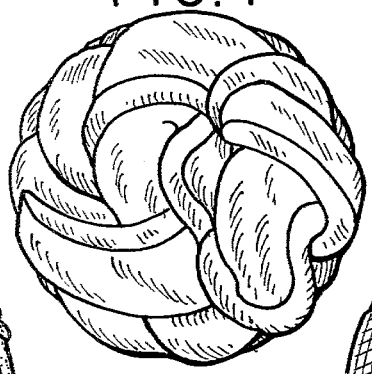
FIG. 1 is a perspective view of the spherical center portion of the ball (core) prepared by wadding a piece or pieces of cloth into a generally spherical shape. This represents the first stage in one embodiment for manufacturing a ball of this invention.

According to the invention and referring to the drawings, for the construction of a substitute baseball, a piece of cloth or other suitable material is preferably wadded into a generally spherical shape with a circumference of preferably about 7 to about $8\frac{1}{4}$ inches, more preferably about 8 inches, to form the core of the ball (FIG. 1). The material used for the core of the ball is preferably scrap acrylic cloth (such as a rag), although other cloths and combinations of cloths, e.g., wool or polyester, or combinations such as wool and polyester or acrylic and polyester, can also be used. An example of another suitable material is scrap rubber sheeting, including reticulated rubber sheeting formed as a by-product of a stamping operation for making rubber products. This core can be comprised of one or more pieces of material.

The material can also be brought to the desired generally spherical shape by a combination of stuffing and rolling. As a second alternative technique for preparing the generally spherically shaped center portion of a substitute baseball, a rectangularly shaped piece of material used for the core can be folded over on itself along one (or both) long side(s) to form a strip, preferably about $2\frac{1}{4}$ to about $2\frac{5}{8}$ inches wide, most preferably about $2\frac{1}{2}$ inches wide, and about 22 inches long. (A rectangular piece of material about 12 inches by about 22 inches is the preferred starting size for the core when a ball having a nominal circumference of 9 inches (baseball size) is being produced.) This strip is then rolled up along the longitudinal axis in such a manner as to maintain as uniform a density for the core as possible and to form a generally cylindrically shaped core of about the same diameter as its height, i.e., about $2\frac{1}{4}$ to about $2\frac{5}{8}$ inches, preferably about $2\frac{1}{2}$ inches. Cohesive tape is then preferably used to at least partially, preferably completely, encase the core to secure the core in the desired configuration and to round the core. Refer to FIGS. 7 through 9 in parent application U.S. Ser. No. 054,310 filed July 9, 1979 and the portion of that application describing this general method of forming the core—albeit the size of the core described there is smaller—which disclosure is incorporated herein by reference.

A core that is as uniform as possible and that is located in as close to the exact center of the ball as possible is desired since a ball having an eccentric center or a center of varying weight and/or shape will not bounce as true or perform in an accepted manner when thrown or hit.

Figure 2:
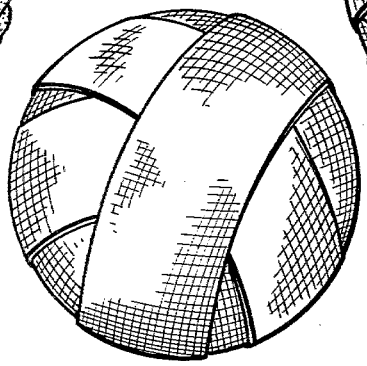
FIG. 2 is a perspective view of the interior of the ball of this invention after the cloth center portion has been covered with cohesive tape.

The generally spherically shaped center portion or core is then preferably completely covered with cohesive tape by winding preferably about 9 to about 13 feet, and most preferably about 11 feet of cohesive tape around the core in a random fashion while maintaining the spherical shape (FIG. 2). The core for a substitute baseball, after having been wrapped with cohesive tape preferably has a circumference of from about 7-1/16 to about 8-5/16 inches.

The cohesive tape used in the subject invention is composed of material which has the property of sticking only to itself and not to other materials. The preferred material, which is sometimes referred to as double-sided tape, has a cheesecloth-like appearance, i.e., has an open structure, and is approximately $\frac{7}{8}$ inch wide and has a weight of about 1 ounce per 60 feet, although other widths, weights and types of cohesive tape may also be used, if available. The cohesive tape preferably used in the subject invention has several advantages. First, by sticking only to itself less difficulty is encountered in working with it; the problem of it sticking to the core or the yarn prematurely, as can occur with conventional tapes, is avoided. Secondly, it is easier to form the piece(s) used to form the core into the desired generally spherical shape. Finally, the cohesive tape contributes to the "springy" and alive feeling that balls having the interior structure of this invention possess.

The cohesive tape-covered center portion (FIG. 2) is then wrapped with yarn (FIG. 3); for a substitute baseball, preferably with about 90 to 100 feet, most preferably about 96 feet of yarn having a weight of about 2.5 ounces per 450 feet is used. The circumference at this stage (FIG. 3) is preferably about $8\frac{7}{8}$ inches. As a second preferred embodiment, yarn having a weight of about 3 ounces per 450 feet can also be used. In this case about 80 to 90 feet of yarn is preferably used when making a substitute baseball. A variety of yarns may be used. Particularly preferred is 4-ply yarn containing 67 percent acrylic and 33 percent polyester. Various weights of yarn may be used, albeit yarns having a weight of from about 2 to about 3.5 ounces per 450 feet are preferred. Heavy yarns such as rug yarns are not desirable.

Figure 3:
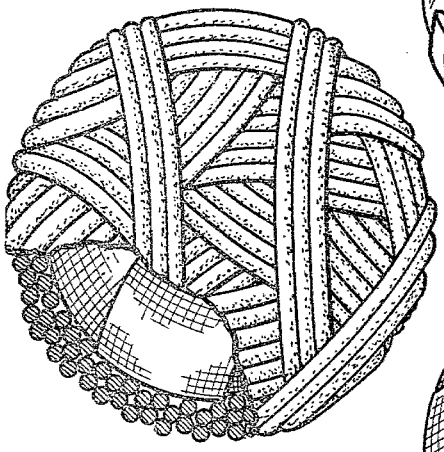
FIG. 3 is a partially cut away perspective view of the interior of the ball after the cohesive tape layer has been covered with yarn.

In the preparation of some balls, e.g., substitute softballs, some yarn may be wrapped around the cohesive tape covered center portion (FIG. 2) following which scrap yarn may simply be placed about the yarn wrapped cohesive tape covered center portion, albeit winding of all the yarn is preferred. In the situation where scrap yarn is placed about the center portion after the cohesive tape covered center portion has been partially wrapped with yarn, additional yarn is then wrapped about the scrap yarn to hold it in position and to complete this stage of the ball preparation process (FIG. 3).

The correct size of the ball at this stage may be obtained by either sizing the yarn-covered intermediate structure with a pattern mold or gauge or by measuring its circumference or diameter. For a substitute baseball (having a nominal 9 inch circumference in the finished form) the yarn-covered intermediate support prior to being covered with tape and then the cover should preferably have a circumference of about $8\frac{7}{8}$ inches.

Figure 4:
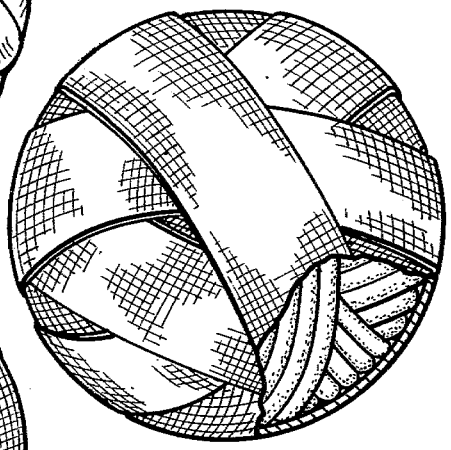
FIG. 4 is a partially cut away perspective view of the interior of the ball after it has been covered with an additional layer of cohesive tape over the yarn.

The yarn-covered center portion of the ball is then preferably covered with an additional layer of cohesive tape (FIG. 4). For a substitute baseball, preferably about 8 to $11\frac{1}{2}$ feet and most preferably about $9\frac{1}{2}$ feet of cohesive tape is used to totally cover the yarn-covered intermediate structure (FIG. 3) with at least one layer of cohesive tape (FIG. 4). If desired, i.e., for the purpose of waterproofing the ball, adhesive tape or some similar waterproof tape, spray or resin can be applied over the cohesive tape. Alternatively, although less desirably, the yarn-covered intermediate structure (FIG. 3) can be covered directly with adhesive tape or a spray or resin to waterproof the ball without the use of cohesive tape at this stage of the preparation.

Figure 5:
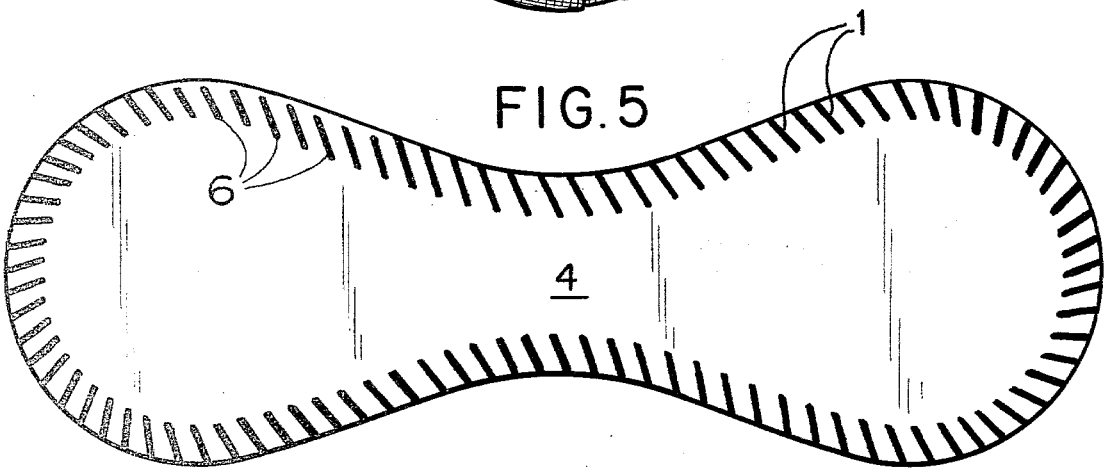
FIG. 5 is a view of one of two substantially identically-shaped cloth pieces used for the cover, upon which short (preferably red) lines 1 have been imprinted or affixed (by, for instance, silk screening) along the perimeter, at an angle to and extending a short distance inwardly from the perimeter.
Figure 6:
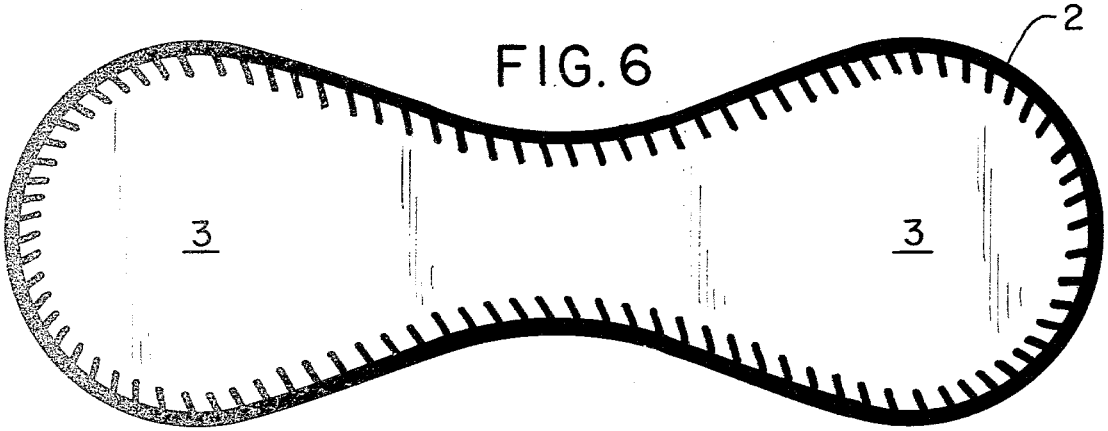
FIG. 6 is a view of the second of the two substantially identically-shaped cloth piece used for the cover, upon which similar short (preferably red) lines have been imprinted or affixed, and which has an additional imprinted or affixed line 2 around the outer perimeter of the figure eight-shaped cloth piece.

The finished ball is then prepared by fitting a synthetic cloth cover (FIGS. 5 and 6 are representative of the two pieces preferably used for the cover) over the tape-covered interior portion of the ball and securing the cover in place (FIGS. 7, 8, 9 and 10) by the method described below. By synthetic cloth is meant cloth containing greater than fifty percent of a synthetic fiber such as polyester, nylon, etc. A cotton cover or the like is not desired since it is not as durable, particularly when the ball becomes wet; the seams tend to split open under the force of being hit by a bat. Polyester is the preferred cover material, particularly polyester double-knit. The use of polyester cloth for the cover, particularly double-knit polyester cloth, which has been cut to substantially the exact size of the ball and the stretched as it is being secured in place has been found to provide a durable, relatively firm ball which maintains its shape well.

The cover is preferably prepared by cutting two figure eight-shaped pieces of cloth (FIGS. 5 and 6). In the preparation of a substitute baseball, each figure eight shaped cloth piece preferably has a length of about 7-7/16 inches, a width at the wide "head" portion 3 of about $2\frac{1}{2}$ inches and a width at the narrow "waist" portion 4 of about $1\frac{3}{8}$ inches. The cloth is preferably of a light weight, e.g., about 6 ounces per square yard. These figure eight-shaped pieces are placed over the ball and secured in place, preferably by sewing them with a raised stitch—the thread in the finished ball is preferably in part raised above the overall nominal surfaces of the ball—using any suitable thread. Polyester thread is particularly desirably because of its durability. As described hereinafter, in the construction of the cloth cover there is an overlap of one figure eight-shaped cloth piece on the other, which overlap itself results in a slightly raised area about the cover. The use of a raised stitch and/or this overlap allows a pitcher to maintain greater control, facilitating the throwing of "junk" pitches, e.g., a knuckle ball, slow curve, etc. The finished substitute baseball will then have a circumference of approximately 9 inches. Preferably, the finished ball should weigh from about 2 to about 3 ounces, more preferably about $2\frac{1}{4}$ to $2\frac{1}{2}$ and most preferably about $2\frac{1}{4}$ ounces. After the cover has been secured in place, the balls are preferably hot-air treated for about ten minutes to remove wrinkles. This hot-air treatment can be carried out in a conventional clothes dryer operating on the appropriate setting for synthetics such as polyester. The temperature used will typically be in the range of about 140° to about 155° F.

Any suitable method can be used to secure the cover over the interior structure of the ball. Preferably, a silk screening process is used to imprint short colored lines 1 (preferably red, although other colors including black may also be used as well as other methods of applying the color, e.g., affixing by embroidery) on one figure eight-shaped piece of synthetic cloth, substantially uniformly along and at an angle (preferably at an angle other than perpendicular to the perimeter at the point of intersection) such that the lines extend inwardly a short distance, preferably about 5/16 inches, from the perimeter (FIG. 5). The lines may extend to the outer edge of this first cloth piece (FIG. 5), but this is not required (see lines 6 in FIG. 5) in the preferred method of preparing the cover because of the overlapping of the second cloth piece (FIG. 6) on the perimeter of the first cloth piece (FIG. 5). The portion of these lines on each piece which shows on the finished ball is preferably about $\frac{1}{4}$ inch. The first cloth piece may also have a colored line along its perimeter, but this is neither necessary nor beneficial. This piece will, therefore, be referred to as the "non-bordered" piece (FIG. 5).

An identically shaped figure eight cloth piece is preferably imprinted, preferably by silk screening although other methods of imprinting or affixing the color could be used, with a colored line 2 along its perimeter, in addition to the short lines preferably at an angle, other than perpendicular to the perimeter at the point of intersection (FIG. 6). Line 2 along the perimeter, when present, is preferably about $\frac{1}{8}$ inch wide. The angled lines of this second piece extend at least to the colored line along the perimeter of the cloth, and may extend to the edge of the cloth. The angled lines on this second cloth piece are preferably about ¼ inch in length. The lines are preferably at substantially the same angle as the angled lines on the non-bordered cloth piece, but this is not required. This second cloth piece (FIG. 6) will be referred to as the "bordered piece."

A trademark, and other verbiage and/or design may also be imprinted on or affixed to one or both of the cloth pieces which will comprise the cover of the ball.

In the preferred construction of the cover for the ball, one end, or "head" portion 3, of the bordered cloth piece is positioned at the narrow "waist" portion 4 of the non-bordered cloth piece (FIGS. 7 and 8), such that the bordered cloth piece is on top of and overlaps the non-bordered cloth piece. This overlap is preferably about ⅛ inch. The reasons for this overlap are twofold. The borderline is desired on the finished product; to achieve this the bordered piece must overlap the non-bordered piece. Also, the border-line facilitates the final closure of the cloth cover by camouflaging the thread used to stitch the cover closed (FIG. 9). It is also preferred that the cloth pieces are positioned such that the angled lines of the bordered cloth piece are aligned with the angled lines of the non-bordered cloth so that the lines would intersect if extended through the border-line along the perimeter of the second cloth piece in such a manner as to simulate stitching. It is preferred that the lines are imprinted or affixed at the same angle on the two cloth pieces such that the simulated stitching on the finished ball forms a row of parallel simulated stitches. However, in an alternate preferred method, the lines may be imprinted or affixed at opposite angles on the two cloth pieces such that the simulated stitching on the finished ball forms a herringbone pattern. Preferably, thread of the same color as the border-line is used to stitch the cloth pieces together to form the cover. The same general technique for preparing the cover can also be used with two non-bordered cloth pieces in which event there will not be a colored line extending around the ball. If this technique is used, the thread used to secure the two cloth pieces together is preferably the same color as the cloth from which the cover is made.

It is also contemplated as within the scope of this invention that neither the first or second cloth pieces making up the cover will have the colored line along the perimeter (2 in FIG. 6). In this situation the short lines extending inwardly a short distance from the perimeter on each of the two cloth pieces should be aligned during the joining of the two cloth pieces such that they intersect or meet on the cover as completed. In this situation, of course, there will not be a colored border line on the finished ball bisecting the simulated stitches as shown in FIG. 11.

In the preferred method for forming the cover, a pocket or cup is formed from the two cloth pieces by continuously stitching along the silk screened border-line of the bordered piece as it overlaps the non-bordered piece. The sewing is preferably done by machine, but this is not required. It would also be possible to join the two cloth pieces by other means, e.g., gluing, but sewing is the preferred method. The cup or pocket formed is left with an opening large enough, e.g., 3½ inches, to allow for the insertion of the interior structure of the ball as in FIG. 10.

The interior structure of the ball is then placed into the pocket or cup (FIG. 10). The opening of the cup is then stitched closed, either by hand or by machine, preferably utilizing the same thread as was used in stitching the cloth pieces together to form the cup. It is also preferable to confine the stitching to the extent possible, and preferably entirely, to the silk screened (or otherwise imprinted or affixed) border-line so that the closure stitches do not show on the finished ball (FIG. 11). This closure stitching, because it is somewhat raised over the overall nominal surface of the ball, allows for greater control in pitching.

Various types of softballs are in use in the United States. These range from a 10 inch (in circumference) ball to the standard 12 inch (in circumference) ball, to the large 16 inch (in circumference) ball which enjoys popularity in certain areas of the United States. The amount of material used for the core of the ball and the amount of yarn used about the center used to prepare substitute softballs can be proportionate to the volumetric amount of these materials used in the substitute baseball described in detail above.

It is apparent from the foregoing that the present invention provides new and useful balls and method for making the same for use in the conventional game of baseball. The present balls can withstand substantial abuse, can be used with at least some conventional pitching machines, are washable, can be used by beginning players where the use of a conventional hard baseball or conventional softballs would be potentially dangerous to the players and can be used where space is limited. The combination of the core of subtantially uniform density, cohesive tape surrounding this core, preferably several wraps of yarn, and additional tape, preferably cohesive, substantially covering the yarn wound center structure provides a ball which is "springy" and alive. Players using it gain a feeling of confidence in its performance and hence in their own.

It should be understood that various changes and modifications can be made in the details of the procedure, without departing from the scope and spirit of the invention; therefore, it is not intended to be limited except as indicated in the appended claims. For example, by increasing or decreasing the tension with which the yarn is wound about the tape-covered cloth core, the amount of yarn used, the density with which the spherical center portion or core is prepared, etc., varying degrees of firmness and durability of the ball may be obtained. If a waterproof ball is desired, any means of waterproofing the interior of the ball may be used. Adhesive tape applied over the second layer of cohesive tape is preferred. However, a spray on adhesive, resin or the like may also be used. The cover preferably used with the interior structure described in detail above is formed from two figure eight-shaped pieces of cloth which have had imprinted thereon (by silk screening or a printing or a heat transfer operation or the like) or affixed thereto (by embroidering or the like) short colored lines which when the cloth pieces are joined, are aligned such that they either intersect (in the situation where no border-line is present) or would intersect if extended through the border-line along the perimeter of the second cloth piece thereby simulating the stitching utilized in the construction of conventional baseballs and the like.

I claim as my invention:

1. A ball comprising:

(a) a generally spherical center portion or core;

(b) cohesive tape at least partially covering said center portion;

(c) yarn covering said cohesive tape-covered center portion;

(d) tape substantially completely covering said yarn; and (e) a synthetic cloth cover;

said ball having the general appearance, size, shape and characteristics, particularly the aerodynamic characteristics, when thrown or hit, of the conventional recreational ball it is meant to replace, but being softer and lighter.

2. The ball of claim 1 wherein said cloth cover is comprised of:

a first and a second generally figure eight-shaped cloth piece, each having an intermediate waist portion and a head portion at each end thereof, and each having imprinted or affixed thereon substantially uniformly spaced short colored lines along and at an angle to the perimeter at the point of intersection of said lines with the perimeter and extending inwardly from the perimeter, and said second cloth piece having imprinted or affixed thereon a line along its perimeter; wherein said first and second cloth pieces are positioned in a head to waist relation and such that the perimeter of said second cloth piece is on top of and slightly overlaps the perimeter of said first cloth piece and said short colored lines extending inwardly on each of said pieces would intersect if extended through said line along the perimeter of said second clothpiece;

said first and said second cloth pieces are joined together along said line along the perimeter of said second cloth piece.

3. The ball of claim 1 wherein said cloth cover is comprised of:

a first and a second generally figure eight-shaped cloth piece, each having an intermediate waist portion and a head portion at each end thereof, and each having imprinted or affixed thereon substantially uniformly spaced short colored lines along and at an angle to the perimeter at the point of intersection of said lines with the perimeter and extending inwardly from the perimeter; wherein said first and second cloth pieces are positioned in a head to waist relation and such that the perimeter of said second cloth piece is on top of and slightly overlaps the perimeter of said first cloth piece and said short colored lines extending inwardly on each of said pieces intersect along the perimeter of said second clothpiece;

said first and said second cloth pieces are joined together along said line along the perimeter of said second cloth piece.

4. The ball of claim 1 wherein said tape of step (d) comprises an adhesive tape.

5. The ball of claim 1 wherein said spherical center portion (step (a) in claim 1) has a diameter of from about 2½ to about 3 inches in diameter and said ball has a nominal circumference of 12 inches.

6. The ball of claim 1 wherein said spherical center portion (step (a) in claim 1) has a diameter of from about 3 to about 4 inches in diameter and said ball has a nominal circumference of 16 inches.

7. The ball of claim 1 wherein said cohesive tape (step (b) in claim 1) substantially completely covers said spherical center portion and said tape (step (d) in claim 1) comprises cohesive tape.

8. The ball of claim 7 wherein the cohesive tape-wrapped center portion of the ball (step (b) in claim 1) has a circumference of from about 7-1/16 to about 8-15/16 inches.

9. The ball of claim 8 wherein said cover is secured in place with polyester embroidery floss thread sewn in a raised stitch and said ball weighs from about 2 to about 3 ounces.

10. The ball of claim 9 wherein said center portion comprises cloth of acrylic material, said yarn is present in an amount of from about 90 to about 100 feet and has a weight of about 2.5 ounces per 450 feet and said synthetic cloth cover is a double-knit polyester.

11. The ball of claim 10 wherein said ball is a substitute baseball with a nominal circumference of 9 inches.

12. In a ball comprised of a generally spherically shaped interior structure and a cover, the improvement which comprises:

a cover comprising a first and a second generally figure eight-shaped cloth piece, each having an intermediate waist portion and a head portion at each end thereof, and each having imprinted or affixed thereon substantially uniformly spaced short colored lines along and at an angle to the perimeter at the point of intersection of said lines with the perimeter and extending inwardly from the perimeter, and said second cloth piece having imprinted or affixed thereon a line along its perimeter; wherein said first and second cloth pieces are positioned in a head to waist relation and such that the perimeter of said second cloth piece is on top of and slightly overlaps the perimeter of said first cloth piece and said short colored lines extending inwardly on each of said pieces would intersect if extended through said line along the perimeter of said second cloth piece;

said first and said second cloth pieces are joined together along said line along the perimeter of said second cloth piece.

13. A method for making a ball comprising:

(a) forming a piece or pieces of material into a generally spherical shape to form the core of said ball;

(b) at least partially covering said core with cohesive tape;

(c) covering the tape-covered structure of step (b) with yarn while maintaining the spherical shape of the structure;

(d) substantially completely covering the yarn-covered spherical structure of step (c) with tape while maintaining the spherical shape of the structure to form the interior structure of the ball; and (e) covering said interior structure of step (d) with a synthetic cloth cover to form the completed ball.

14. The method of claim 13 wherein step (e) is carried out by:

(a) forming a first and a second generally figure eight-shaped cloth piece, each having an intermediate waist portion and a head portion at each end thereof, and each having imprinted or affixed thereon substantially uniformly spaced short colored lines along and at an angle to the perimeter at the point of intersection of said lines with the perimeter and extending inwardly from the perimeter, and said second cloth piece having imprinted or affixed thereon a line along its perimeter;

(b) aligning said first and second cloth pieces such that one of said head portions of said second cloth piece is placed on top of and slightly overlaps said waist portion of said first cloth piece and the lines extending inwardly on each of said pieces would intersect if extended through said line along the perimeter of said second cloth piece;

(c) joining said first and said second cloth pieces together along the imprinted or affixed perimeter line of said second cloth piece while maintaining the positioning of the inwardly extending lines on each of said first and said second cloth pieces as in step (b) to form a cup having an opening sufficiently large to allow said interior structure of said ball (step (d) of claim 13) to be inserted into said cup;

(d) inserting said interior structure of said ball into said cup;

(e) closing said cup about said interior structure by completing said joining of said first and second cloth pieces along said imprinted or affixed perimeter line of said second cloth piece to form the completed ball.

15. The method of claim 14 in which an additional final step comprises subjecting the completed ball (step (e) of claim 13) to hot air treatment.

16. The method of claim 15 in which said short colored lines of step (a) in claim 14 which are imprinted or affixed on said first and said second cloth pieces along and at an angle other than perpendicular to the perimeter at the point of intersection and extending inwardly from the perimeter are positioned in such a manner as to create a herringbone pattern of simulated stitching on the finished ball.

17. The method of claim 15 in which said short colored lines of step (a) in claim 14 which are imprinted or affixed on said first and said second cloth pieces along and at an angle other than perpendicular to the perimeter at the point of intersection and extending inwardly from the perimeter are positioned in such a manner as to create a pattern of parallel lines of simulated stitching on the finished ball.

* * * * *